US006880779B1

(12) United States Patent
Heinonen et al.

(10) Patent No.: US 6,880,779 B1
(45) Date of Patent: Apr. 19, 2005

(54) METHOD FOR CHANGING LINEAR LOAD ON A REEL-UP

(75) Inventors: Mikko Heinonen, Appleton, WI (US); Jarkko Räty, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/889,438

(22) PCT Filed: Jan. 12, 2000

(86) PCT No.: PCT/FI00/00019

§371 (c)(1),
(2), (4) Date: Dec. 2, 2002

(87) PCT Pub. No.: WO00/41959

PCT Pub. Date: Jul. 20, 2000

(30) Foreign Application Priority Data

Jan. 12, 1999 (FI) ..... 990044

(51) Int. Cl.[7] ..... B65H 18/16; B65H 18/26
(52) U.S. Cl. ..... 242/541.7; 242/542.3
(58) Field of Search ..... 242/541.7, 541.4, 242/542.3

(56) References Cited

U.S. PATENT DOCUMENTS 2,703,683 A 3/1955 Evans et al.
3,202,374 A 8/1965 Phelps
3,614,011 A 10/1971 Karr
4,634,068 A 1/1987 Malkki et al.
5,184,787 A 2/1993 Holzinger et al.

(Continued)

FOREIGN PATENT DOCUMENTS

WO 9424033 10/1994

*Primary Examiner*—John M. Jillions
(74) *Attorney, Agent, or Firm*—Steinberg & Raskin, P.C.

(57) ABSTRACT

In the method for changing linear load on a reel-up which comprises an initial reeling device (9), a reeling shaft (1), a surface drive apparatus or the like, and a loading device (8) for the reeling process taking place after initial reeling, the reeling begins as a so-called initial reeling in the initial reeling device (9) from which the reeling shaft (1) and the initial portion of the reel formed thereon is transferred to the loading device by means of which the stages following the formation of the initial portion of the reel are conducted, in such a manner that the part (8) of the loading device which transmits load to the reeling shaft (1) is brought in contact with the reeling shaft (1). The force devices of the initial reeling device (9) and the loading device are primarily utilized to effect the linear load in the nip between the reel formed around the reeling shaft (1) and the surface drive apparatus or the like, the linear load being adjusted during the reeling by means of force devices in such a manner that the desired linear load is attained as a function of given factors. The contact of the part (8) that transmits load to the reeling shaft takes place when the loading device is substantially in a state devoid of loading force.

7 Claims, 2 Drawing Sheets

U.S. PATENT DOCUMENTS 5,249,758 A 10/1993 Muller et al.
5,375,790 A 12/1994 Svanqvist ..... 242/541.1
5,544,841 A 8/1996 Didier et al. ..... 242/541.1
6,129,305 A 10/2000 Moller et al. ..... 242/541
6,145,778 A * 11/2000 Tuominen et al. ..... 242/541.7
6,325,323 B1 * 12/2001 Olsson ..... 242/541.7

* cited by examiner

METHOD FOR CHANGING LINEAR LOAD ON A REEL-UP

FIELD OF THE INVENTION

The present invention relates to a method for changing the linear load on a reel-up of a paper web. The reel-up primarily comprises an initial reeling device, a reeling shaft, a reeling cylinder and a loading device.

BACKGROUND OF THE INVENTION

The concept of linear load refers to the force required in the reeling, which loads the paper reel formed on the reeling shaft. Said force required in the reeling is applied to the reel formed on the reeling shaft primarily via the reeling cylinder in such a way that the necessary force, linear load, is generated via the nip between the outer perimeter of said reeling cylinder and the outer perimeter of the reel that is being formed, when the loading of said nip is at least primarily generated by means of force devices acting on the ends of the reeling shaft. In the initial reeling device the formation of the bottom portion of the reel on the reeling shaft takes place, whereafter the reeling shaft is transferred to the loading device to be reeled to form a full paper reel.

The force loading the nip can be adjusted by means of control signals derived on the basis of the position of the initial reeling device and the loading device in such a way that the loading of the nip is dependent in a predetermined manner on a possible initial reeling angle, the diameter of the growing reel, or time, i.e. the linear load changes as a function of a measurable factor. At the transfer stage, in which the reeling shaft and the reel to be formed thereon are transferred from the support and loading applied by said initial reeling device or the like to the loading effected by the loading device, a force peak which disturbs the reeling process is often generated in the linear load.

Said reel-up is generally used for example for reeling up of a paper web passed for example from a paper machine or a finishing device for paper. The reel-up in question is a continuous reel-up in which machine reels are reeled successively. When the reel has become full, the web is changed to travel to a new reeling shaft. The web is reeled around the reeling shaft and in the reel-up the reel which is gradually growing into its full size, is pressed against the reeling cylinder by means of a loading device, the web travelling over the reeling cylinder in a particular sector and the reeling cylinder being rotated at a peripheral speed corresponding to the desired speed of the web. Before the reel is completed, a new reeling shaft can, when accelerated to the running speed, be brought in nip contact with the reeling cylinder by means of the initial reeling device in such a way that it also attains the corresponding peripheral speed. As soon as the paper reel has attained the desired diameter, it is transferred away from the reeling cylinder. Thus, its peripheral speed starts to become lower, which results in that a web loop is formed between the new reel shaft and the complete reel. This loop is guided e.g. by means of a pressurized air jet to wind around a new reel shaft, and it is torn off from the finished reel as a result. There are also other known ways of change.

Because of the variations in the loading, it is a problem in the aforementioned transfer stage especially when reeling takes place at high speeds, that wrinkles are produced in the inner layers of the reels in such a manner that the bottom portion of the reels is rejected as a broke. The amount of paper discharged as broke may be as high as 2 to 3%, which causes considerable financial losses for the paper mill.

A known method for changing the linear load on the reel-up is disclosed for example in the patent FI-71107, and in the corresponding U.S. Pat. No. 4,634,068. Here, secondary forks are driven against the reeling shaft which is initially reeled in primary forks, in such a manner that the forks hit the reeling shaft. The linear load is controlled in this transfer stage by evenly reducing the loading produced by the primary forks, and by evenly increasing the loading of the secondary forks at the same time, wherein the sum linear load remains substantially equal. The impact on the reeling shaft, however, always results in a clear linear load peak. Thus, in addition to the change of the loading, the disturbance is also caused by the transfer of the loading device to a position where it can receive the reel from the initial reeling device, and the latter factor can act in the transfer of the loading, even though the linear load could be controlled well by controlling the actuators affecting the loading at the transfer stage.

For example in the generally used reel-up type, there are reeling carriages which can be moved in the longitudinal direction of the machine (machine direction), which reeling carriages function as a loading device when the reel is completed after the initial reeling. The carriages are provided with guide jaws, which press the ends of the reeling shaft towards the reeling cylinder. The guide jaws press the reeling shaft with a force, which is determined according to the force of the actuators used for moving the reeling carriages. When the actuators are used to drive the carriage against the reeling shaft, a certain pressure always prevails therein to ensure the movement, the pressure causing a "load stroke" when the guide jaws touch the reeling shaft.

SUMMARY OF THE INVENTION

By means of the method according to the invention, it is possible to avoid additional loading exerted on the reeling shaft at that stage when the reeling shaft is transferred from the initial reeling device to the loading of that loading device by means of which most of the reel is formed.

By means of the method according to the invention, the variation of the loading occurring in the change of the reeling shaft can be minimized even further, and thus the paper reels are formed in such a manner that they are of uniform quality for example in view of further processing procedures. The invention is based on the adjustment of the positions or location of the guide jaws as well as on the adjustment of the force of the loading device before the transfer stage in such a manner that no loading peak is generated.

BRIEF DESCRIPTION OF THE DRAWINGS

In the following, the method according to the invention will be described by means of an example with reference to the appended drawings, in which.

DETAILED DESCRIPTION OF THE INVENTION

Figure 1:
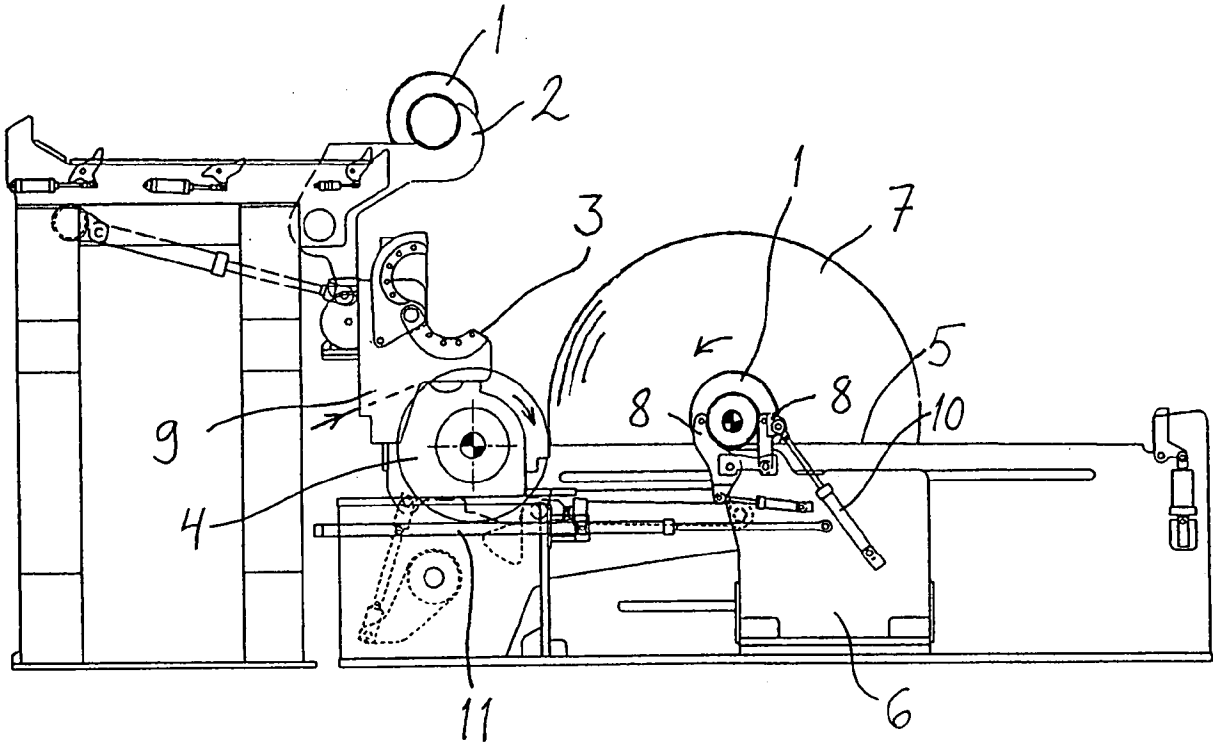
FIG. 1 shows a side-view of a reel-up type as an example.

The method according to the invention is implemented by means of a reel-up according to FIG. 1, in which locking jaws 3 of the initial reeling device 9 correspond to the primary forks of the aforementioned patent FI-71107 and secondary jaws 8 journalled pivotable in the vertical plane in reeling carriages 6 correspond to the secondary forks of the patent, the jaw on the side of the reeling cylinder 4 being a locking jaw and the jaw on the other side of the end of the reeling shaft being a guide jaw. The reeling carriages 6 move along guide rails by means of linear bearings and hydraulic cylinders 11 which produce the loading of the reel, and of which the term "loading actuator" will be used hereinbelow. The loading device by means of which the reel is loaded against the reeling cylinder 4, is composed of hydraulic cylinders 11 and a mechanism by means of which the hydraulic cylinders are in a power transmitting connection with the ends of the reeling shaft, more precisely with the bearing housings of the reeling shaft. The mechanism, by means of which the force of the hydraulic cylinders is transmitted to the ends of the reeling shaft, is in this case composed of the reeling carriages 6 and the guide jaws 8. For the purpose of measuring the diameter of the reel, the reeling carriages 6 are provided with devices for measuring the position, which are placed on both sides of the machine. In the reel-up, the reel is supported in a known manner by the ends of the reeling shaft by means of reeling rails 5 or corresponding supporting elements.

According to FIG. 1, in the beginning of the change of the reeling shaft, the initial reeling device 9 is in the upper position and the locking jaws 3 of the initial reeling device are open. The clutch of the initial reeling drive is also open. In the reeling shaft storage there is an empty reeling shaft to be picked up by lowering arms 2.

The reeling shaft 1 is lowered to the initial reeling device 9 by means of lowering arms 2. The jaws 3 of the initial reeling device are automatically locked as soon as the reeling shaft 1 is positioned down in the jaws 3 of the initial reeling device 9. The clutch of the initial reeling drive is closed and it is shifted to crawling mode. The empty reeling shaft 1 is accelerated to the web speed and the initial reeling device 9 is turned a given distance, for example into a certain angular position with respect to the reeling cylinder 4, or in such a manner that the reeling shaft 1 is lowered on the rails. The nip between the reeling cylinder 4 and the reeling shaft 1 is automatically closed at some point during the turning movement. The reeling carriages 6 are transferred to a change position when the paper reel has reached the desired diameter. The reel is thus transferred away from the reeling cylinder 4. The web is changed on a new reeling shaft 1 by a suitable manner.

The act of stopping the full reel 7 takes place by braking. When the reel 7 has stopped, the braking ceases. The guide jaws 8 and the locking jaws 8 of the reeling carriages 6 turn downward automatically, whereafter the full reeling shaft 1 rolls along the rails 5 to a stopper, wherefrom it can be transferred away from the machine by means of a crane.

During the process of moving the full reel 7 away from the machine, the web is reeled on the reeling shaft 1 located in the initial reeling device 9, and the reel is loaded against the reeling cylinder 4 by means of the actuators of the initial reeling device 9, which act upon the ends of the reeling shaft via the locking jaws 3. At the next stage the initial reeling device 9 is turned down on the rails 5 if the change has been conducted in the upper angular position of the reeling shaft, and the reeling carriages 6 are guided towards the reeling shaft 1 located on top of the rails 5 in the initial reeling device 9.

Figure 2:
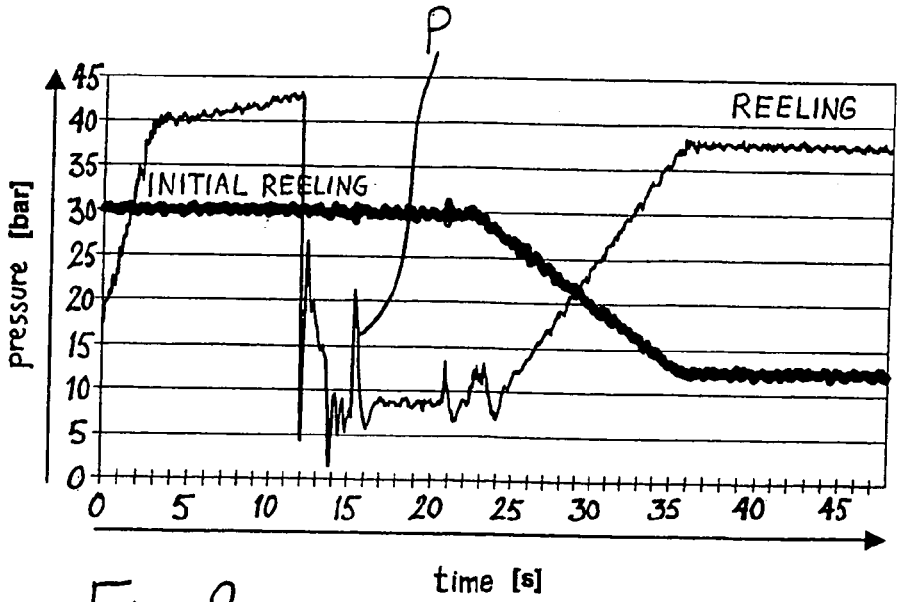
FIG. 2 shows loading pressures of prior art at the transfer stage.

FIG. 2 illustrates the pressure levels of the actuators responsible for the loading of the initial reeling device 9 and the pressure levels of the loading actuators 11 responsible for the loading of the reeling carriages at a transfer stage. The guide jaws 8 have been turned up by means of actuators 10 located in the reeling carriages 6, wherein the guide jaw causes a pressure peak marked with the letter P when it hits the reeling cylinder, and a corresponding loading peak in the reel-up.

In the invention the contact of the loading device with the reeling shaft takes place without loading force, in other words the loading actuators 11 are devoid of the force effecting the linear load.

Figure 3:
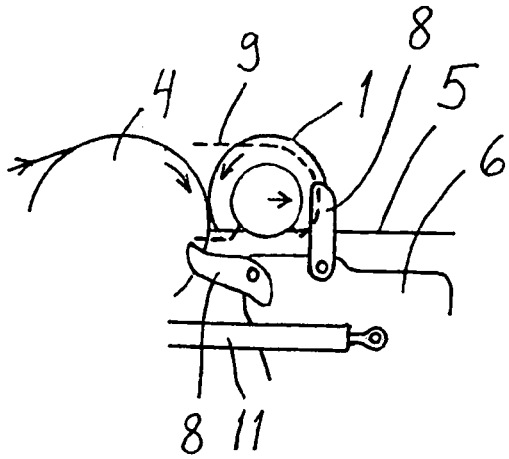
FIG. 3 shows schematically the first embodiment of the method.

According to the first embodiment of the invention (FIG. 3), the carriages 6 are guided towards the reeling shaft 1 at a very low speed, the guide jaws 8 being positioned in the upper position, and the carriages 6 are stopped approximately 10 mm before the guide jaws 8 enter in contact with the reeling shaft 1 in the initial reeling device 9. At this stage, when the guide jaws 8 are not yet in contact with the reeling shaft 1, pressure is switched off from the loading actuators 11, and their chambers are open to the tank lines via valves. The next step is to wait until the diameter of the web reel R grows to such a dimension that the end of the reeling shaft 1 is transferred against the guide jaw 8 and starts to move the reeling carriages 6 along itself. This can be detected from the position information of the reeling carriages 6, for example by means of a sensor indicating the position. Thus, the locking jaws 8 of the reeling carriages 6 can be lifted up on the opposite side of the ends of the reeling shaft 1, wherein they lock the reeling shaft 1 to the reeling carriages 6 when they are closed. At the same time the pressure can be switched to the loading actuators. The change of the linear load takes place for example according to principle described in the publication FI-71107 and shown in FIG. 2, in such a manner that the loading effected by the initial reeling device 9 is reduced from a given starting level to the zero level at the same time when the loading caused by the reeling carriages is increased, until the loading equals the loading of the initial reeling device 9 before starting the change, in other words the overall loading remains constant. The principle is thus the same as the one in FIG. 2, but the act of increasing the loading of the loading device and thereby the act of increasing the linear load begins from zero. A linear load peak is not generated because the guide jaws 8 are not driven against the reeling shaft, but the web reel can grow into engagement with the reeling carriages 6 freely.

Figure 4:
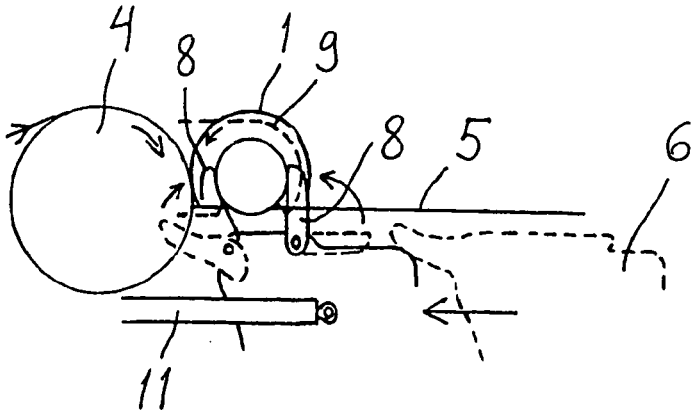
FIG. 4 shows schematically a second embodiment of the method.

According to a second alternative (FIG. 4), the reeling carriages are driven to a load transfer position when both the guide jaws and the locking jaws are in the lower position. The guiding carriages are transferred to the correct position by position control in such a manner that the jaws are closed on both sides of the ends of the reeling shaft 1. When the jaws 8 are closed, the force of the loading actuators 11 is set to 0 N, wherein the contact to the reeling shaft 1 takes place without loading force, and a loading peak does not occur. In practice the reeling carriages 6 are set to force control mode and the force target is set to 0 N. Thereafter the loading is increased in a similar manner as described above.

In both alternatives the loading forces can be ramped clearly from zero to the linear load force by means of the loading device and from the linear load force to zero by means of the initial reeling device. Both forces can be changed evenly, wherein the graph of the sum linear load illustrating their overall effect as a function of the time is also linear.

When the load of the drive has been changed, the clutch of the initial reeling drive opens automatically and the drive is stopped. The locking jaws 3 of the initial reeling device 9 are opened and it is guided upwards into the initial position of the change sequence. Then the initial reeling device 9 is ready to receive a new reeling shaft from a storage of reeling shafts for the next change.

The function of the reel-up is controlled with a control system, which is based on programmable control logic known as such or on a corresponding control system, by means of which the aforementioned adjustments can be implemented. The motion of the reeling carriages 6 can be controlled in a precise manner by means of position control, wherein said reeling carriages and the guide jaws 8 therein will be positioned accurately with respect to the reeling shaft 1 before they enter in contact with the reeling shaft and before the load is increased.

It is obvious that the invention is not restricted to the above-described example, but it can vary within the scope of the claims. In the above-described reel-up type there is a reeling carriage 6 on both sides of the frame of the reel-up, which reeling carriage moves in a linear manner and is in a power transmitting connection with the corresponding end of the reeling shaft 1. Both the reeling cylinder 4 and the reeling shaft 1 are rotated during the reeling, i.e. the reel-up in question is a centre-drive assisted reel-up. The reel-up type and/or the details of the reel-up can, however, differ from those mentioned above. The reel-up can for example function by surface drive, wherein for example only the reeling cylinder 4 is driven. It is common to all reel-ups in which the invention can be applied that they are provided with a loading device which is driven into contact with a reeling shaft at that stage when the paper web has already been reeled around the reeling shaft in the initial reeling. The moment of the change can also be selected in such a manner that most of the reeling process is conducted by means of the initial reeling device and only a short time before the reel change the reel is changed to the loading devices. Thus, in this context, the initial reeling device has to be regarded as a device in which it is possible to reel the web around the reeling shaft and which causes a load which can be changed to a load effected by another loading device for the duration of the final reeling. The reel-up can be provided e.g. with two pairs of reeling carriages.

The reeling cylinder 4 can be replaced with any surface drive apparatus, which forms a nip with the reel, in which nip the aforementioned linear load is effective. The surface drive apparatus can be for example a belt and roll assembly.

What is claimed is:

1. Method for changing linear load on a reel-up which comprises an initial reeling device (9) having force devices, a reeling shaft (1), a surface drive apparatus, and a loading device comprising a loading actuator for a reeling process taking place after initial reeling, in which method the reeling takes place in the following way:

the reeling begins as initial reeling in the initial reeling device (9) from which the reeling shaft (1) and the initial portion of the reel formed thereon is transferred to the loading device by means of which the stages following the formation of the initial portion of the reel are conducted, in such a manner that a part (8) of the loading device which transmits load to the reeling shaft (1) is brought in contact with the reeling shaft (1), the force devices of the initial reeling device (9) and the loading actuator of the loading device are primarily utilized to effect the linear load in the nip between the reel formed around the reeling shaft (1) and the surface drive apparatus, the linear load being adjusted during the reeling by means of the force devices and the loading actuator in such a manner that a desired linear load is attained as a function of given factors, characterized in that when the reeling shaft (1) is transferred from the initial reeling device (9) to the loading device, the contact of the part (8) that transmits load to the reeling shaft (1) takes place when the loading device is substantially in a state devoid of loading force, whereafter the loading by means of the loading device is started, and performed in such a fashion that the movement of the part (8) that transmits load to the reeling shaft towards the reeling shaft (1) is stopped before said part (8) enters in contact with the reeling shaft (1) located in the initial reeling device (9) and the reeling shaft (1) is allowed to move in contact with said part by increasing the diameter of the reel produced around the reeling shaft by continuously reeling the web on the reeling shaft (1).

2. Method according to claim 1, wherein the transfer of the load applied to the reeling shaft (1) from the initial reeling device (9) to the loading device is started when the diameter of the reel formed around the reeling shaft (1) has been allowed to grow so large that it starts to move or transfer the loading device.

3. Method according to claim 1, wherein at the stage when the load applied to the reeling shaft (1) is transferred from the initial reeling device (9) to the loading device, within a given time the loading caused by the initial reeling device (9) is reduced from a given initial value nearly down to zero or to zero at the same time when the loading of the loading device is increased from zero to a given final value.

4. Method according to claim 3, wherein the loading of the loading device is increased evenly and the loading of the initial reeling device (9) is reduced evenly in such a manner that the sum linear load graph illustrating their overall effect as a function of time is linear.

5. Method according to claim 1, wherein the initial reeling device (9) comprises locking jaws (3) and the loading device comprises reeling cartridges that have pivotable guide jaws, whereby during the initial reeling, the reeling shaft (1) is kept in the locking jaws (3) of the initial reeling device (9), and during the transfer of the loads the pivotable guide jaws (8) of the reeling carriages (6) are movable by means of the loading actuators (11) which start to load the reeling shaft (1).

6. Method for changing linear load on a reel-up which comprises an initial reeling device (9) having force devices, a reeling shaft (1), a surface drive apparatus, and a loading device comprising a loading actuator for a reeling process taking place after initial reeling, in which method the reeling takes place in the following way:

the reeling begins as initial reeling in the initial reeling device (9) from which the reeling shaft (1) and the initial portion of the reel formed thereon is transferred to the loading device by means of which the stages following the formation of the initial portion of the reel are conducted, in such a manner that a part (8) of the loading device which transmits load to the reeling shaft (1) is brought in contact with the reeling shaft (1), the force devices of the initial reeling device (9) and the loading actuator of the loading device are primarily utilized to effect the linear load in the nip between the reel formed around the reeling shaft (1) and the surface drive apparatus, the linear load being adjusted during the reeling by means of the force devices and the loading actuator in such a manner that a desired linear load is attained as a function of given factors, characterized in that when the reeling shaft (1) is transferred from the initial reeling device (9) to the loading device, the contact of the part (8) that transmits load to the reeling shaft (1) takes place when the loading device is substantially in a state devoid of loading force, whereafter the loading by means of the loading device is started, said contact being performed in such a fashion that the part (8) that transmits load to the reeling shaft is transferred close to the reeling shaft (1), whereafter the part (8) is transferred into contact with the reeling shaft (2) kinetically independently of the motion of the loading actuator (11) while the loading device is at least in the moment of contact in a state devoid of loading force.

7. A method for changing the linear load on a reel-up which includes an initial reeling device, a reeling shaft, a surface drive apparatus and a loading device for a reeling process which takes place after said initial reeling, the method comprising the steps:

winding a web around a reeling shaft at an initial reeling device to form a reel;

moving said reeling shaft and reel formed thereon from the initial reeling device to said loading device;

adjusting a loading part of said loading device so that said loading part is in a non-loading state;

placing said reel in contact with said loading part while said loading part is in said non-loading state; and, continuously winding said web around the reeling shaft to thereby increase a diameter of said reel until said reel is placed in contact with said loading part of said loading device.

* * * * *